US007592974B2

(12) United States Patent
Suzuki et al.

(10) Patent No.: US 7,592,974 B2
(45) Date of Patent: Sep. 22, 2009

(54) DISPLAY DEVICE

(75) Inventors: Masahiro Suzuki, Yamanashi-ken (JP); Tetsuya Shigeta, Tokyo (JP)

(73) Assignee: Pioneer Corporation, Tokyo (JP)

( * ) Notice: Subject to any disclaimer, the term of this patent is extended or adjusted under 35 U.S.C. 154(b) by 656 days.

(21) Appl. No.: 11/123,212

(22) Filed: May 6, 2005

(65) Prior Publication Data

US 2005/0264482 A1 Dec. 1, 2005

(30) Foreign Application Priority Data

May 7, 2004 (JP) ..... 2004-138403

(51) Int. Cl.
*G09G 3/28* (2006.01)

(52) U.S. Cl. ..... 345/60; 345/63

(58) Field of Classification Search ..... 345/211, 345/42, 204, 214, 60, 63, 102, 76; 340/870.03, 340/870.02, 825.22; 324/142; 713/300; 455/456.1, 12.1, 573; 348/372
See application file for complete search history.

(56) References Cited

U.S. PATENT DOCUMENTS 4,700,188 A * 10/1987 James ..... 340/870.03
5,481,252 A * 1/1996 Kwon et al. ..... 340/825.22
5,696,501 A * 12/1997 Ouellette et al. ..... 340/870.02
5,809,310 A * 9/1998 Fukuda et al. ..... 713/300
5,870,685 A * 2/1999 Flynn ..... 455/573
5,933,092 A * 8/1999 Ouellette et al. ..... 340/870.02
6,429,642 B1 * 8/2002 Rodilla Sala ..... 324/142
6,618,837 B1 * 9/2003 Zhang et al. ..... 716/4
6,738,412 B1 * 5/2004 Hayakawa ..... 375/130
6,891,525 B2 * 5/2005 Ogoro ..... 345/102
6,967,646 B2 * 11/2005 Hosoi et al. ..... 345/204
7,486,333 B2 * 2/2009 Kawakami ..... 348/372
2002/0118182 A1 * 8/2002 Luther Weindorf ..... 345/204
2002/0186185 A1 * 12/2002 Ide et al. ..... 345/60
2003/0011543 A1 1/2003 Hosoi et al.
2003/0191986 A1 * 10/2003 Cyran et al. ..... 714/32
2003/0193451 A1 10/2003 Kimura
2003/0203717 A1 * 10/2003 Chuprun et al. ..... 455/12.1
2004/0164933 A1 * 8/2004 Weitbruch et al. ..... 345/63
2005/0024301 A1 * 2/2005 Funston ..... 345/76
2005/0032525 A1 * 2/2005 Gasbarro ..... 455/456.1
2005/0270283 A1 * 12/2005 Plut ..... 345/211

FOREIGN PATENT DOCUMENTS

JP 2003-29698 1/2003
JP 2004-4606 1/2004

* cited by examiner

*Primary Examiner*—Prabodh M. Dharia
(74) *Attorney, Agent, or Firm*—Drinker Biddle & Reath LLP

(57) ABSTRACT

Disclosed is an user-friendly display device for operating with a power consumption desired by the user. The display device comprises: a characteristic acquisition unit for obtaining a characteristic indicative of a correspondence relationship between an average peak level and the number of display pulses corresponding to a target power consumption; an average peak level detector for detecting an average peak level of an input image signal; a driving control unit for determining the number of display pulses corresponding to the detected average peak level with reference to the characteristic; a driver for generating a display pulse a number of times equal to the number determined by the driving control unit; and a display panel for receiving the display pulses supplied from the driver to emit light at a luminance depending on the number of display pulses.

10 Claims, 10 Drawing Sheets

FIG. 6

| GRADATION LEVEL | CONVERSION TABLE | | LIGHT EMISSION PATTERN | | | | | | | | | | | | | | |
|---|---|---|---|---|---|---|---|---|---|---|---|---|---|---|---|---|---|
| | PDs | GD 1 2 3 4 5 6 7 8 9 10 11 12 13 14 15 | SF 1 | SF 2 | SF 3 | SF 4 | SF 5 | SF 6 | SF 7 | SF 8 | SF 9 | SF 10 | SF 11 | SF 12 | SF 13 | SF 14 | SF 15 |
| 0 | 0000 | 1 0 0 0 0 0 0 0 0 0 0 0 0 0 0 | ● | | | | | | | | | | | | | | |
| 1 | 0001 | 0 1 0 0 0 0 0 0 0 0 0 0 0 0 0 | ○ | ● | | | | | | | | | | | | | |
| 2 | 0010 | 0 0 1 0 0 0 0 0 0 0 0 0 0 0 0 | ○ | ○ | ● | | | | | | | | | | | | |
| 3 | 0011 | 0 0 0 1 0 0 0 0 0 0 0 0 0 0 0 | ○ | ○ | ○ | ● | | | | | | | | | | | |
| 4 | 0100 | 0 0 0 0 1 0 0 0 0 0 0 0 0 0 0 | ○ | ○ | ○ | ○ | ● | | | | | | | | | | |
| 5 | 0101 | 0 0 0 0 0 1 0 0 0 0 0 0 0 0 0 | ○ | ○ | ○ | ○ | ○ | ● | | | | | | | | | |
| 6 | 0110 | 0 0 0 0 0 0 1 0 0 0 0 0 0 0 0 | ○ | ○ | ○ | ○ | ○ | ○ | ● | | | | | | | | |
| 7 | 0111 | 0 0 0 0 0 0 0 1 0 0 0 0 0 0 0 | ○ | ○ | ○ | ○ | ○ | ○ | ○ | ● | | | | | | | |
| 8 | 1000 | 0 0 0 0 0 0 0 0 1 0 0 0 0 0 0 | ○ | ○ | ○ | ○ | ○ | ○ | ○ | ○ | ● | | | | | | |
| 9 | 1001 | 0 0 0 0 0 0 0 0 0 1 0 0 0 0 0 | ○ | ○ | ○ | ○ | ○ | ○ | ○ | ○ | ○ | ● | | | | | |
| 10 | 1010 | 0 0 0 0 0 0 0 0 0 0 1 0 0 0 0 | ○ | ○ | ○ | ○ | ○ | ○ | ○ | ○ | ○ | ○ | ● | | | | |
| 11 | 1011 | 0 0 0 0 0 0 0 0 0 0 0 1 0 0 0 | ○ | ○ | ○ | ○ | ○ | ○ | ○ | ○ | ○ | ○ | ○ | ● | | | |
| 12 | 1100 | 0 0 0 0 0 0 0 0 0 0 0 0 1 0 0 | ○ | ○ | ○ | ○ | ○ | ○ | ○ | ○ | ○ | ○ | ○ | ○ | ● | | |
| 13 | 1101 | 0 0 0 0 0 0 0 0 0 0 0 0 0 1 0 | ○ | ○ | ○ | ○ | ○ | ○ | ○ | ○ | ○ | ○ | ○ | ○ | ○ | ● | |
| 14 | 1110 | 0 0 0 0 0 0 0 0 0 0 0 0 0 0 1 | ○ | ○ | ○ | ○ | ○ | ○ | ○ | ○ | ○ | ○ | ○ | ○ | ○ | ○ | ● |
| 15 | 1111 | 0 0 0 0 0 0 0 0 0 0 0 0 0 0 0 | ○ | ○ | ○ | ○ | ○ | ○ | ○ | ○ | ○ | ○ | ○ | ○ | ○ | ○ | ○ |

○ : SUSTAIN DISCHARGE ● : ERASE ADDRESSING DISCHARGE

FIG. 14A 50 kWh/month

FIG. 14B 400 kWh/year

FIG. 14C

200 W
50 kWh/month

FIG. 14D

200 W
50 kWh/month
1,000 yen/month

DISPLAY DEVICE

BACKGROUND OF THE INVENTION

1. Field of the Invention

The present invention relates to a technique for controlling a light-emission luminance of an image to be displayed on a display device such as a plasma display.

2. Description of the Related Art

A plasma display has a plurality of discharge cells arranged in a matrix form, and emits light through production of gas discharges in selected discharge cells to generate ultraviolet rays which excite fluorescent materials within the selected discharge cells. An image can be displayed at luminance levels or gradation levels of halftone by controlling the number of occurrences of the discharge per unit time in the discharge cells, i.e., the number of times a discharge sustain pulse is supplied to the discharge cells. According to a sub-field method commonly used for driving a plasma display, one field corresponding to one image is divided into a plurality of sub-fields, and ratios of sustain periods for light emission in the respective sub-fields are set to a power of two. Various combinations of the sub-fields make grayscale display. For example, when ratios of sustain periods for light emission in eight sub-fields are set to $2^0:2^1:2^2:2^3:2^4:2^5:2^6:2^7$, i.e., 1:2:4:8:16:32:64:128, 256 gradation levels can be implemented by combining the sub-fields. Techniques related to the sub-field method are disclosed, for example, in Japanese Patent Kokai No. 2004-4606.

An existing plasma display has an ABL (Automatically Brightness Limit) function which variably sets the number of discharge sustain pulses in each sub-field in accordance with an average peak level (APL) of an input image signal in order to mainly reduce power consumption. The plasma display having the ABL function stores a characteristic curve indicative of the relationship of the number of discharge sustain pulses to an average peak level in a memory, and determines the number of discharge sustain pulses in accordance with a detected average peak level with reference to this characteristic curve. With this ABL function, the plasma display can reduce brightness or luminance over an entire screen by reducing the number of discharge sustain pulses in each sub-field when a high average peak level is detected, and increases brightness or luminance over the entire screen by increasing the number of discharge sustain pulses in each sub-field when a low average peak level is detected. For example, Japanese Patent Kokai No. 2003-29698 discloses an ABL function for a plasma display. The plasma display described in Japanese Patent Kokai No. 2003-29698 stores a plurality of kinds of characteristic curves, for example, a characteristic curve for standard use, a characteristic curve for burn-in prevention, a characteristic curve for power saving, and the like in a memory. A user can arbitrarily select a curve from among these characteristic curves, depending on the situation.

As described above, the ABL function mainly aims at power saving for the plasma display, but even if the ABL function is performed using the characteristic curve for power saving, the user cannot realize an actual amount of power consumption, and has no awareness of actively selecting the characteristic curve for power consumption. Also, even the characteristic curve for power saving is selected, the plasma display is not always operating with a small amount of power consumption as expected by the user.

SUMMARY OF THE INVENTION

In view of the foregoing, it is an object of the present invention to provide a display device capable of operating with the amount of power consumption desired by the user, and configured for user-friendly operation.

According to one aspect of the present invention, a display device is provided. The display device comprises: a characteristic acquisition unit for obtaining a characteristic indicative of a correspondence relationship between an average peak level and the number of display pulses corresponding to a target power consumption; an average peak level detector for detecting an average peak level of an input image signal; a driving control unit for determining the number of display pulses corresponding to the detected average peak level with reference to the characteristic; a driver for generating a display pulse a number of times equal to the number of display pulses determined by the driving control unit; and a display panel for receiving the display pulses from the driver to emit light at a luminance depending on the number of display pulses.

Further features of the invention, its nature and various advantages will be more apparent from the accompanying drawings and the following detailed description of the preferred embodiments.

BRIEF DESCRIPTION OF THE DRAWINGS

FIG. 6 is a diagram showing a relationship between gradation levels and sub-fields;

FIG. 14A is a diagram showing an example of displaying a power consumption for one month;

FIG. 14B is a diagram showing an example of displaying a power consumption for one year;

FIG. 14C is a diagram showing an example of presenting a simultaneous display of a current power consumption and a power consumption for one month; and FIG. 14D is a diagram showing an example of presenting a simultaneous display of a current power consumption, a power consumption for one month and the electric rate.

DETAILED DESCRIPTION OF THE INVENTION

In the following, various embodiments of the present invention will be described with reference to the drawings.

Figure 1:
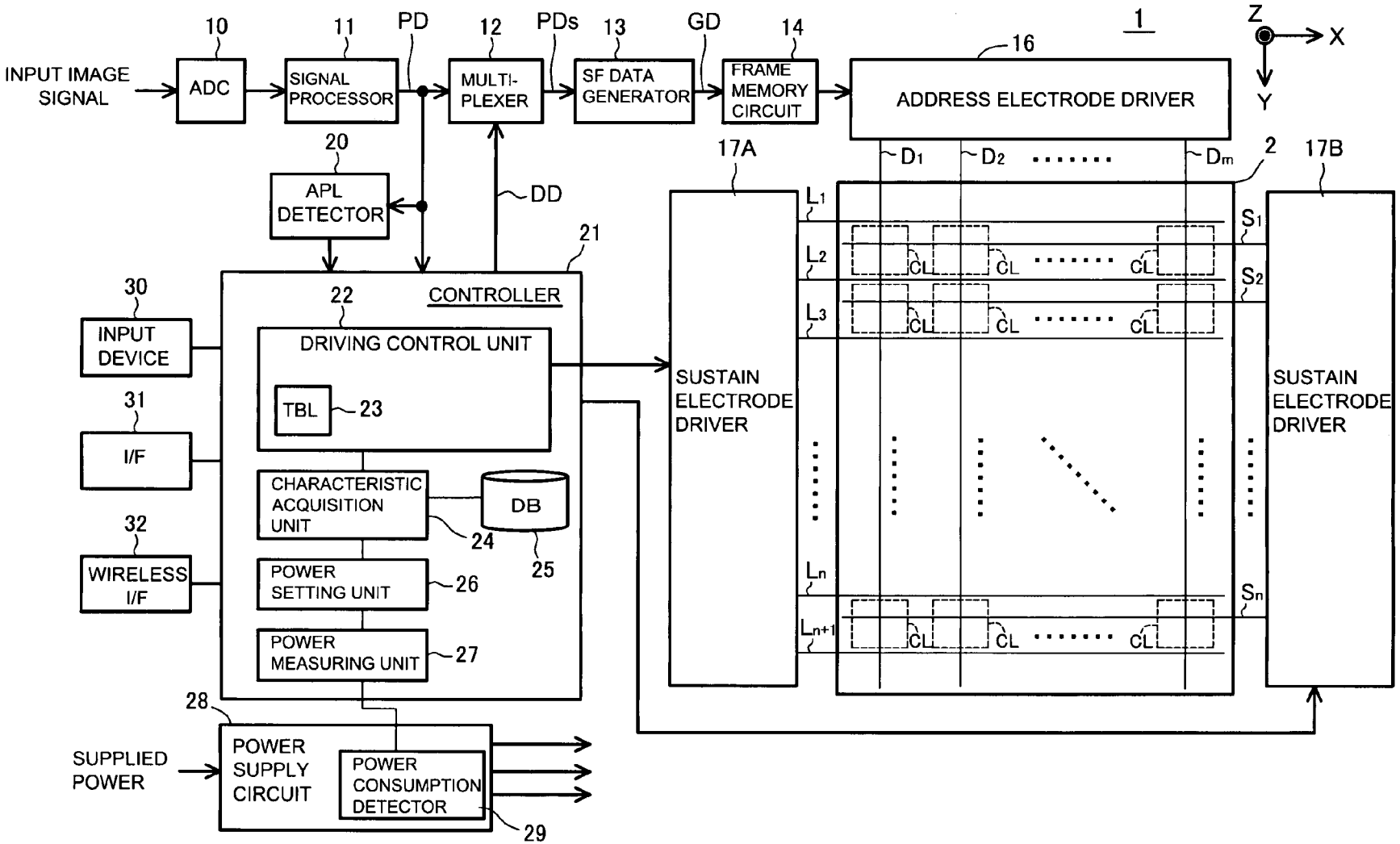
FIG. 1 is a block diagram schematically showing a configuration of a plasma display which is an embodiment of the present invention.

FIG. 1 is a block diagram schematically illustrating a configuration of a plasma display (display device) which is an embodiment of the present invention. This plasma display 1 comprises a display panel (plasma display panel) 2, and an address electrode driver 16 and sustain electrode drivers 17A, 17B for driving the display panel 2. The address electrode driver 16 and sustain electrode drivers 17A, 17B make up a driver of the present invention. The plasma display 1 further comprises an A/D converter (ADC) 10; a signal processor 11; an SF data generator 13; a frame memory circuit 14; an APL detector (average peak level detector) 20; a controller 21; and a power supply circuit 28.

The power supply circuit 28 generates operating voltages using externally supplied power and supplies the operating voltages to all processing blocks of the plasma display 1. The power supply circuit 28 incorporates a power consumption detector 29 for detecting the power consumption of the plasma display 1. The power consumption detector 29 supplies the detected power consumption to the controller 21.

An input image signal is composed of R (red), G (green), B (blue) analog signals. The A/D converter 10 samples and quantizes the R, G, B analog signals, respectively, to generate 8-bit R, G, B digital image signals which are output to the signal processor 11. The signal processor 11 performs error diffusion processing and dither processing on the digital image signals from the A/D converter 10 to generate an image signal PD which is supplied to a multiplexer 12, controller 21, and APL detector 20. The signal processor 11 performs the error diffusion processing for diffusing the low two bits of an 8-bit image signal to the high six bits of each surrounding pixel to generate a 6-bit signal. The signal processor 11 further adds an element of a dither matrix to the 6-bit signal resulting from the error diffusion processing, generates a 4-bit image signal PD by bit-shifting the resultant signal, and supplies the 4-bit image signal.

The multiplexer 12 superimposes display data from the controller 21 onto the image signal PD supplied from the signal processor 11 to generate a multiplexed image signal PDs which is output to the SF data generator 13. The SF data generator 13 generates SF data (sub-field data) GD based on the multiplexed image signal PDs according to the sub-field method, and outputs the SF data GD to the frame memory circuit 14. The frame memory circuit 14 temporarily stores the input SF data in an internal buffer memory (not shown), and reads SF data stored in the buffer memory and supplies the read SF data to the address electrode driver 16. The address electrode driver 16 generates address pulses based on the SF data input thereto, and supplies the address pulses to address electrodes $D_1$-$D_m$ at a predetermined timing.

The display panel 2 comprises: a plurality of discharge cells CL arranged in a matrix form; m (m is an integer equal to or larger than two) address electrodes $D_1, \ldots, D_m$ extending in a Y-direction from the address electrode driver 16; (n+1) (n is an integer equal to or larger than two) sustain electrodes $L_1, \ldots, L_{n+1}$ extending in an X-direction perpendicular to the Y-direction from the first sustain electrode driver 17A; and n sustain electrodes $S_1, \ldots S_n$ extending in a −X direction from the second sustain electrode driver 17B. The discharge cells CL are formed in respective regions near intersections of the address electrodes $D_1$-$D_m$ with the sustain electrodes $L_1$-$L_{n+1}$, $S_1$-$S_n$.

Figure 2:
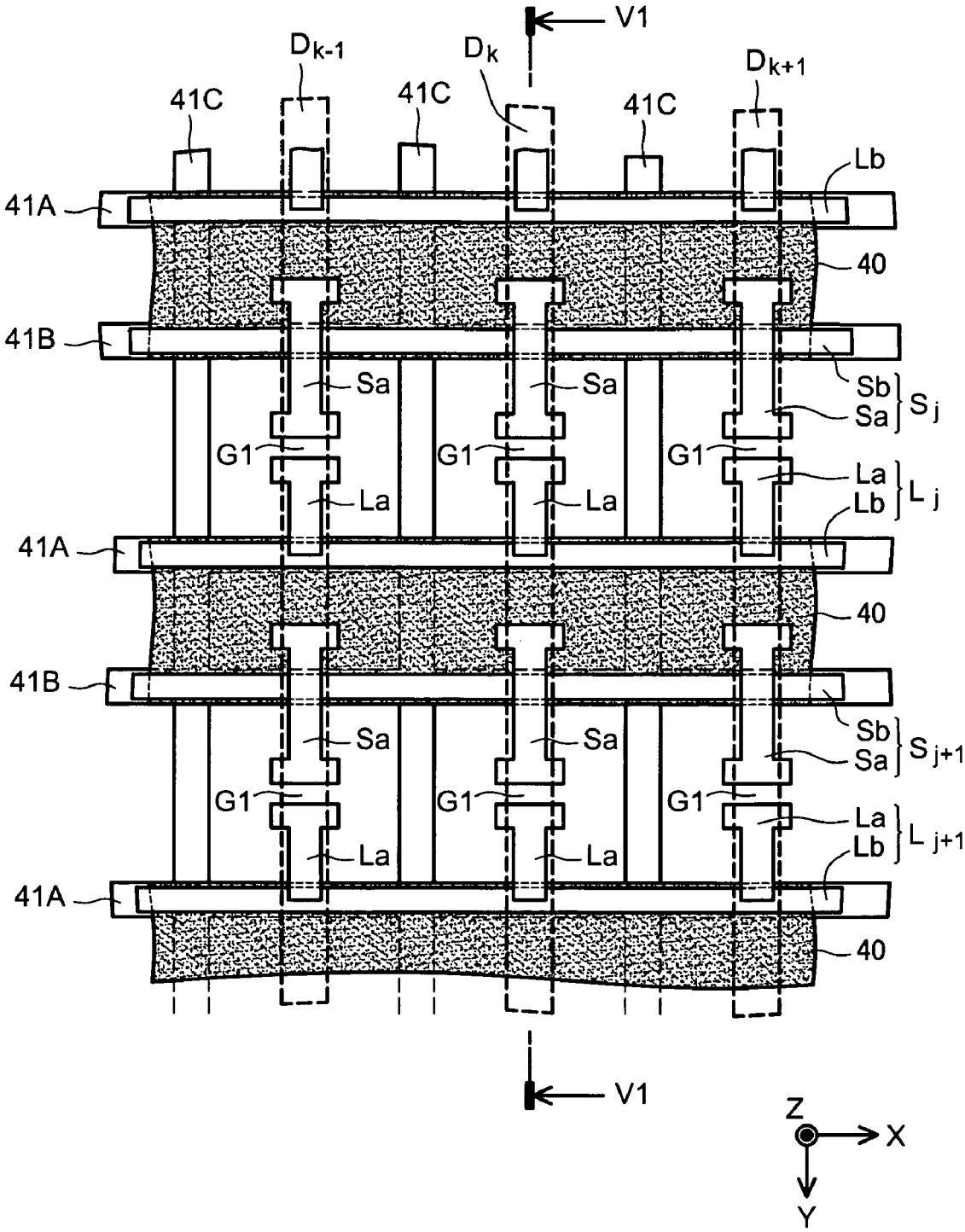
FIG. 2 is a plan view showing a partial region of a display panel.
Figure 3:
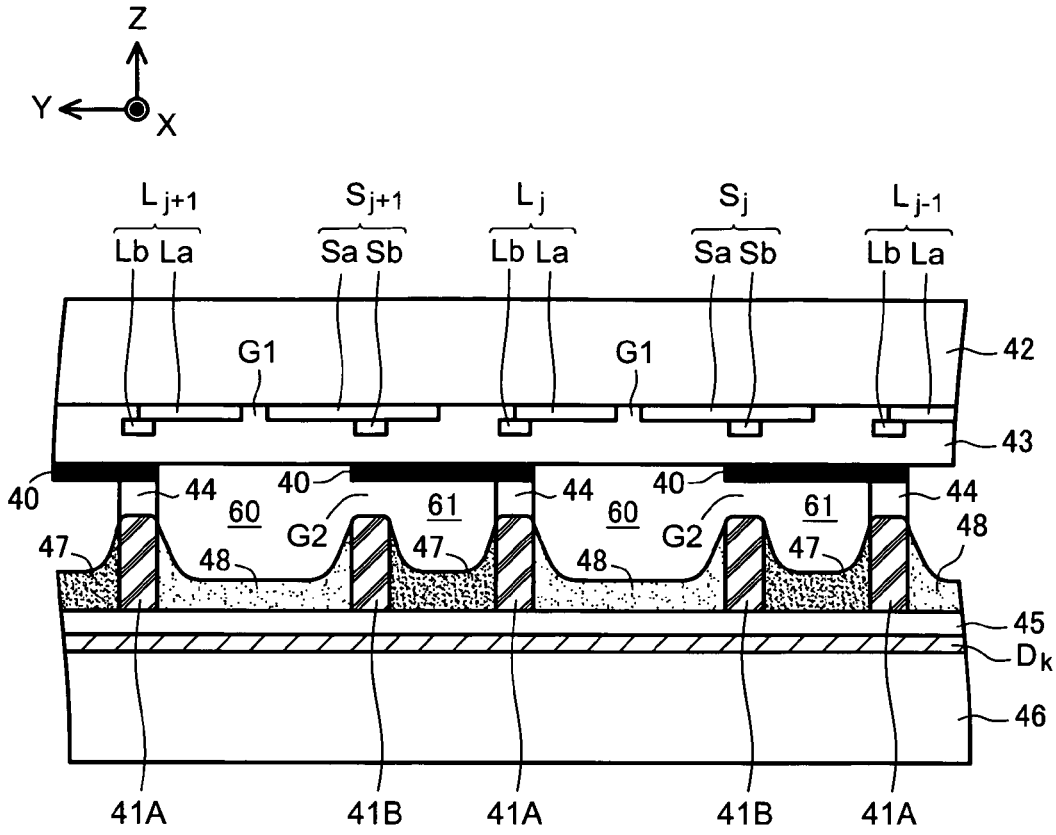
FIG. 3 is a cross-sectional view taken along a V1-V1 line of the display panel shown in FIG. 2.

A plan view of a partial region of the display panel 2 is shown in FIG. 2. FIG. 3 is a cross-sectional view taken along a V1-V1 line of the display panel 2 shown in FIG. 2. Referring to FIG. 2, each of the sustain electrodes $S_j$, $S_{j+1}$ (j is an integer from one to n−1) is composed of a flat bar-shaped bus electrode Sb extending in the −X direction, and a flat bar-shaped transparent electrodes Sa connected to the bus electrode Sb and extending in the Y-direction. The transparent electrode Sa, which is made of a electrically conductive transparent material such as ITO (indium tin oxide), has T-shaped ends. The bus electrode Sb is made of a black or a dark metal film. Each of the sustain electrodes $L_j$, $L_{j+1}$ is composed of a flat bar-shaped bus electrode Lb extending in the X-direction and made of a black or a dark metal film, and a flat bar-shaped transparent electrodes La connected to the bus electrode Lb and extending in the Y-direction. The transparent electrode La, which is made of a electrically conductive transparent material such as ITO, has a T-shaped leading end opposing one leading end of the transparent electrode Sa across a discharge gap G1. As shown in FIG. 3, these sustain electrodes $S_j$, $S_{j+1}$, $L_j$, $L_{j+1}$ are formed on the back of a transparent front substrate 42, and a front dielectric layer 43 is deposited to cover the sustain electrode $S_j$, $S_{j+1}$, $L_j$, $L_{j+1}$. On the front dielectric layer 43, light-absorbent dielectric layers (black stripes) 40 containing a black or a dark pigment, extend in the X-direction in strip form. A protection film (not shown) made of MgO (magnesium oxide) is formed on the back of the front dielectric layer 43 and black stripes 40.

On the other hand, on a back substrate 46 opposing the front substrate 42, flat bar-shaped address electrodes $D_{k-1}$, $D_k$, $D_{k+1}$ (k is an integer from one to m−1) are deposited, extending in the Y-direction. As shown in FIG. 2, each of the address electrodes $D_{k-1}$, $D_k$, $D_{k+1}$ is arranged to oppose a pair of transparent electrodes Sa, La in the Z-direction (depth direction of the front substrate 42). Referring to FIG. 3, a back dielectric layer (protection layer) 45 is formed to cover these address electrodes $D_{k-1}$, $D_k$, $D_{k+1}$ for protection, and partitions (ribs) 41A, 41B, 41C, continuous over an X-Y plane, are disposed on the back dielectric layer 45. First partitions 41A are disposed in a stripe form along the X-direction beneath the bus electrodes Lb, respectively, while second partitions 41B are disposed in a stripe form along the X-direction beneath the bus electrodes Sb, respectively. A dielectric material 44 is stacked between the first partitions 41A and the black stripes 40. Third partitions 41C are disposed to define respective spaces above the address electrodes on the back dielectric layer 45 in the X-direction. As shown in FIG. 3, the partitions (ribs) 41A, 41B, 41C form a main discharge space 60 between a pair of transparent electrodes La, Sa and the address electrode $D_k$, and form a sub-discharge space 61 between the leading end of the transparent electrode Sa and the address electrode $D_k$. The main discharge space 60 and the sub-discharge space 61 are in communication with each other through a gap G2 between the black stripe 40 and the second partition 41B. Also, the main discharge space 60 and sub-discharge space 61 are filled with a discharge gas made of Xe (xenon) or the like which generates ultraviolet rays through a discharge.

An electron emission layer 47 made of a secondary electron emission material having a relatively low work function, for example, MgO (magnesium oxide), BaO (barium oxide) or the like is formed on an inner wall exposed to the sub-discharge space 61. A fluorescent layer 48 is coated on an inner wall exposed to the main discharge space 60 for emitting red (R), green (G), or blue (B) light when it absorbs ultraviolet rays generated through a gas discharge. The discharge cell CL shown in FIG. 1 corresponds to an area defined by the first partitions 41A, 41A and third partitions 41C, 41C, and each discharge cell CL has one main discharge space 60 and one sub-discharge space 61. The foregoing description has been made of a structure of the display panel 2.

Referring next to FIG. 1, the APL detector 20 detects an average peak level (APL) of an image signal transmitted from the signal processor 11 every field period or at intervals of a predetermined number of field periods, and supplies the detected average peak level to the controller 21. The detected average peak level is used for obtaining characteristic curve and ABL processing, as described later.

The controller 21 comprises a driving control unit 22, a characteristic acquisition unit 24, a database 25, a power setting unit 26, and a power measuring unit 27, and is connected to an input device 30, an output interface unit (I/F) 31, and a wireless interface unit (wireless I/F) 32. Though not explicitly shown in the figure, the controller 21 can control the A/D converter 10, signal processor 11, multiplexer 12, SF data generator 13, frame memory circuit 14, and address electrode driver 16.

The input device 30 comprises a key input device, a pointing device or the like, and can be used by a user to enter data such as numerical values. The input device 30 supplies to the controller 21 an input value from the user or a command corresponding to the input value. The output interface unit 31 is connected to an external device such as a media receiver, a set top box or the like, and has a function of outputting data supplied from the controller 21 to an external device connected thereto. The wireless interface unit 32 has a function of making a short-distance wireless communication with an external device, for example, a remote operation device such as a remote controller, via an infrared link.

The driving control unit 22 controls the SF data generator 13, frame memory circuit 14, address electrode driver 16, first sustain electrode driver 17A, and second sustain electrode driver 17B in accordance with the image signal PD input from the signal processor 11 and the value of the detected average peak level supplied from the APL detector 20. The following description will be made of a gradation driving method implemented by the driving control unit 22.

Figure 4:
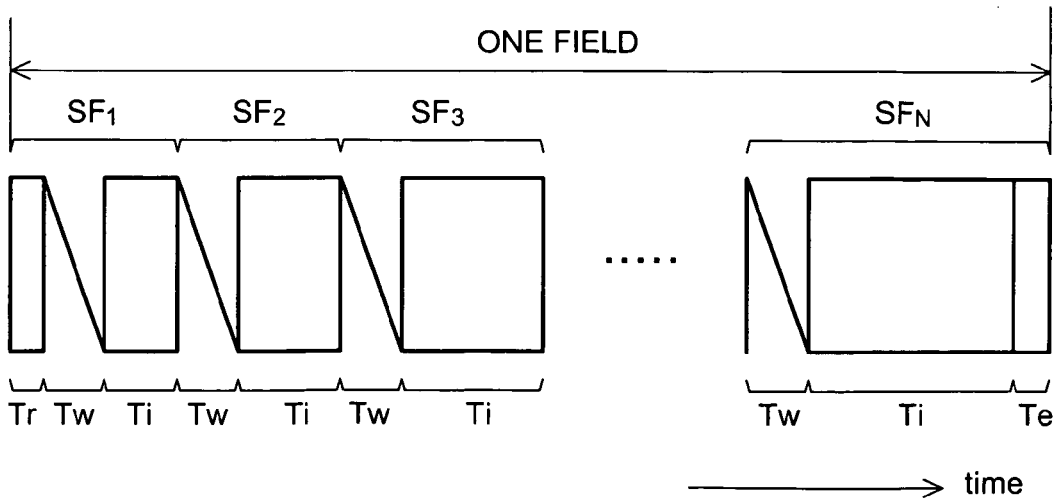
FIG. 4 is a diagram showing an example of a driving sequence for light emission used by a plasma display.

FIG. 4 illustrates an example of a driving sequence for light emission. One field is divided into N (N is an integer equal to or larger than one) sub-fields $SF_1$ to $SF_N$, each of which has an addressing period Tw and a light emission sustain period Ti. Only the first sub-field $SF_1$ has a reset period Tr immediately before the addressing period Tw, while only the last sub-field $SF_N$ has an erase period Te immediately after the light emission sustain period Ti.

Figure 5:
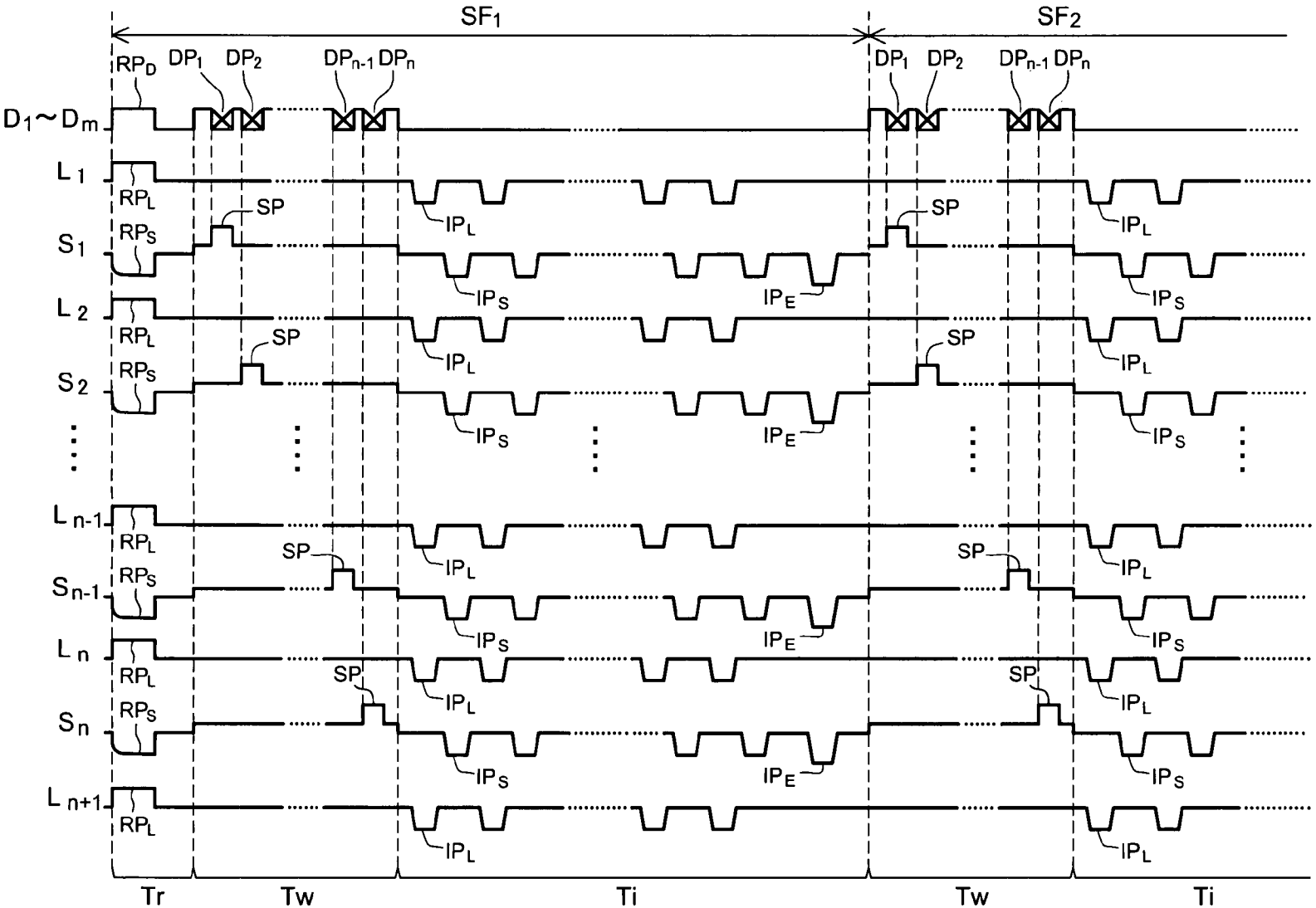
FIG. 5 is a timing chart schematically showing waveforms of pulses supplied to the display panel.

FIG. 5 is a timing chart schematically showing waveforms of pulses supplied to the display panel 2 in the reset period Tr, addressing period Tw, and light emission sustain period Ti. Referring to FIG. 5, first, in the reset period Tr of the first sub-field $SF_1$, the first sustain electrode driver 17A supplies reset pulses $RP_L$ of positive polarity to the sustain electrodes $L_1, \ldots, L_{n+1}$, respectively, the second sustain electrode driver 17B supplies reset pulses $RP_S$ of negative polarity to the sustain electrodes $S_1, \ldots, S_n$, respectively, and the address electrode driver 16 supplies reset pulses $RP_D$ of positive polarity to the address electrodes $D_1, \ldots, D_m$, respectively. In this reset period Tr, a gas discharge (reset discharge) occurs in the discharge spaces 60, 61 between the transparent electrode Sa and the address electrode $D_k$ Of the display panel 2 shown in FIG. 3, causing charges to be generated in the sub-discharge space 61. The charges move into the main discharge space 60 through the gap G2. As a result, a wall charge is accumulated on the surface of the fluorescent layer 48 of the main discharge space 60 in each of all the discharge cells CL.

In the next addressing period Tw, an erase addressing discharge is produced selectively in discharge cells CL to be turned off, to extinguish the wall charges. Specifically, as shown in FIG. 5, the second sustain electrode driver 17B sequentially supplies a scanning pulse SP of positive polarity to the address electrodes $D_1, \ldots, D_m$. In this event, the address electrode driver 16 sequentially supplies address pulses $DP_1, \ldots, DP_n$ synchronized to the timing at which each scanning pulse SP is applied. Specifically, the address electrode driver 16 supplies to the address electrodes $D_1$-$D_m$ the address pulses $DP_1$ synchronized to the scanning pulse SP supplied to the sustain electrode $S_1$ on a first line, and then supplies the address electrodes $D_1$-$D_m$ with the address pulses $DP_2$ synchronized to the scanning pulse SP supplied to the sustain electrode $S_2$ on a second line. The address electrode driver 16 repeatedly performs the foregoing processing until it supplies the address pulses $DP_n$ synchronized to the scanning pulse SP supplied to the sustain electrode $S_n$ on the last line. In this addressing period Tw, a gas discharge (erase addressing discharge) occurs in the space between the address electrode $D_k$ and the transparent electrode Sa shown in FIG. 3 in each of those discharge cells CL to be turned on. As a result, the wall charges accumulated in the discharge cells CL are extinguished.

In the next light emission sustain period Ti, the first sustain electrode driver 17A repeatedly supplies discharge sustain pulses $IP_L$ of negative polarity to the sustain electrodes $L_1, \ldots, L_{n+1}$, respectively, the number of times assigned thereto, while the second sustain electrode driver 17B repeatedly supplies discharge sustain pulses IPS of negative polarity to the sustain electrodes $S_1, \ldots, S_n$, respectively, the number of times assigned thereto. The amplitude of the last discharge sustain pulses $IP_E$ supplied to the sustain electrodes $S_1$-$S_n$ is set to be slightly larger than that of the previous discharge sustain pulse $IP_S$. As a result, in the discharge cells CL in which the wall charge is formed, a gas discharge (sustain discharge) occurs near a pair of transparent electrodes Sa, La in the main discharge space 60 shown in FIG. 3. The fluorescent layer 48 absorbs ultraviolet rays generated through this discharge, and excites to emit light in one of R, G, B.

In the addressing period Tw in the next sub-field $SF_2$, as described above, the erase addressing discharge is produced in the discharge cells CL to be turned off, to extinguish the wall charges. In the next light emission sustain period Ti, the sustain electrode drivers 17A, 17B repeatedly supply the discharge sustain pulses $IP_L$, $IP_S$ as described above numbers of times assigned thereto. Subsequently, the processing is performed in the sub-fields $SF_3$-$SF_N$ as shown in FIG. 4, and in the last erase period Te, the wall charges are extinguished by simultaneously producing erase discharges in all the discharge cells CL.

FIG. 6 illustrates a relationship between gradation levels of image data $PD_S$ and the sub-fields $SF_1$-$SF_{15}$. The SF data generator 13 converts 4-bits of image data PDs supplied from the multiplexer 12 to 15-bits of SF data GD in accordance with a conversion table shown in FIG. 6, and outputs the SF data GD to the frame memory circuit 14. Specifically, when the gradation level of the input data PDs is "0," the least significant bit (LSB) of the SF data GD is set to "1," and each of the remaining bits is set to "0." When the gradation level of the input data PDs is "k" (k is an integer from one to 14), a (k+1)-th bit of the SF data GD is set to "1," and all the remaining bits are set to "0." When the gradation level of the input data PDs is "15," all the bits from the least significant bit to the most significant bit (MSB) of the SF data are set to "0."

The address electrode driver 16 receives the SF data GD from the frame memory 14, samples and latches the SF data GD for one horizontal line, then generates an address pulse corresponding to the value of each bit of the image data GD, and supplies the address pulses to the address electrodes $D_1$-$D_m$. Referring to FIG. 6, when the LSB of the SF data GD has the value "1," an erase addressing discharge occurs to extinguish the wall charges in those discharge cells CL to be turned off, in the addressing period Tw of the first sub-field $SF_1$. When a k-th bit (k is an integer from one to 14) of the SF data GD has the value "1," a sustain discharge occurs in those discharge cells CL which have the wall charges, in each light emission sustain period Ti of the first to (k−1)-th sub-fields $SF_1$-$SF_{k-1}$, and an erase addressing discharge occurs in the addressing period Tw of the k-th sub-field $SF_k$. When all the bits from the LSB to the MSB of the SF data GD have the value "0," a sustain discharge occurs in those discharge cells CL which have the wall charges, in each light emission sustain period Ti of all the sub-fields $SF_1$-$SF_{15}$, and no erase addressing discharge occurs in the addressing period Tw.

The foregoing driving method is different from the driving method which sets ratios (weights) of light emission sustain periods assigned to each sub-field to a power of two, as described in the aforementioned Japanese Patent Kokai No. 2004-4606. The driving method of this embodiment employs a selective erase addressing method which only requires one time for each of the reset period Tr and erase period Te in each of the discharge cells CL in each field period (display period). Therefore, after the wall charges have been accumulated in all the discharge cells CL of the display panel 2 at the beginning of each field, the discharge cells CL will continue to emit light until the wall charges are erased by the erase addressing discharge, thereby advantageously preventing a pseudo contour when a moving image is displayed.

Figure 7:
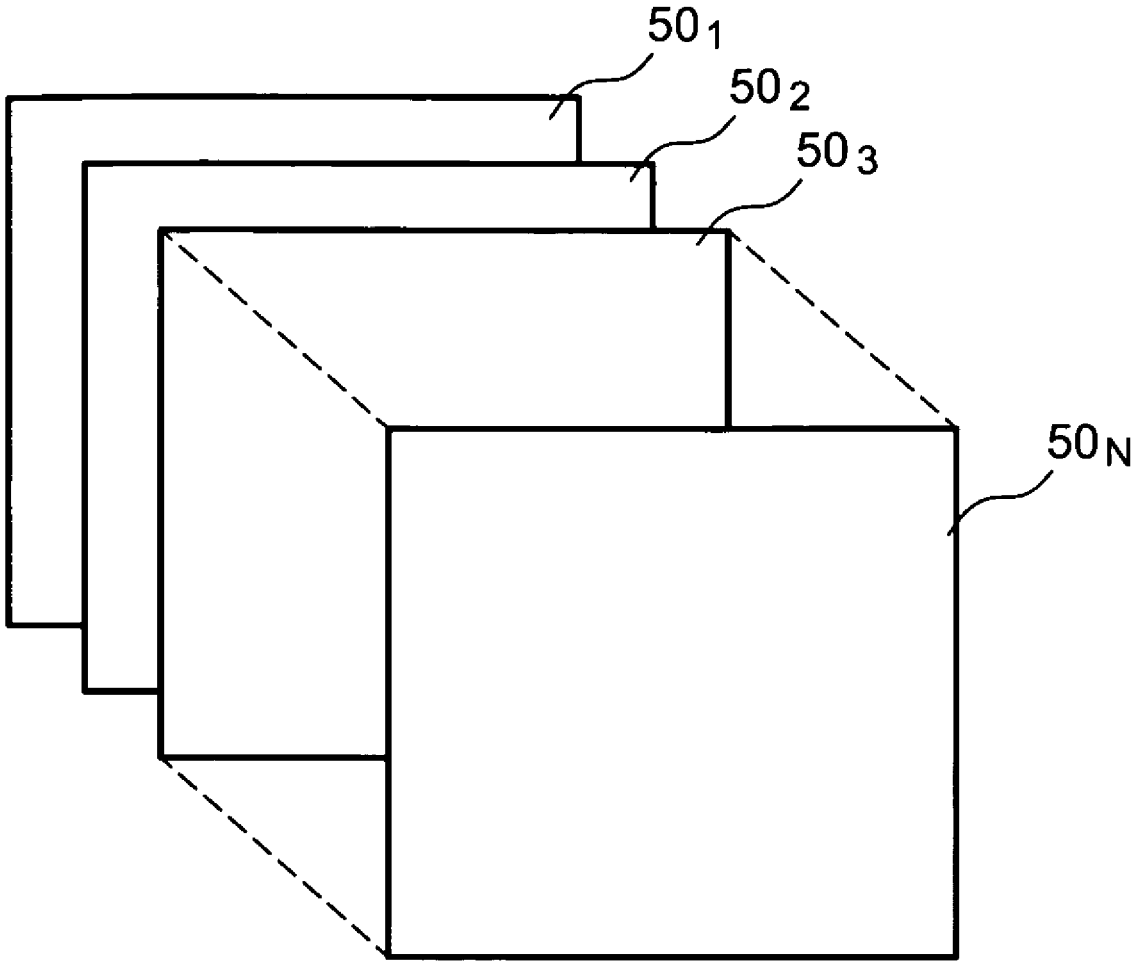
FIG. 7 is a diagram showing lookup tables corresponding to the respective sub-fields.

The driving control unit 22 has the characteristic setting unit 23 which stores the characteristic representing a correspondence relationship between the average peak level (APL) and the number of occurrences of light emission (the number of times of supplying a discharge sustain pulse), i.e., a lookup table (characteristic table). The driving control unit 22 determines the number of discharge sustain pulses for each sub-field in accordance with the detected average peak level supplied from the APL detector 20 with reference to the lookup table set in the characteristic setting unit 23, and assigns the determined numbers of discharge sustain pulses to the sub-fields $SF_1$-$SF_N$ (FIG. 4), respectively. The numbers of discharge sustain pulses assigned to the respective sub-fields $SF_1$-$SF_N$ are stored in a register (not shown). The characteristic setting unit 23 stores lookup tables $\mathbf{50}_1, \ldots, \mathbf{50}_N$ corresponding to the respective sub-fields $SF_1, \ldots, SF_N$, as show in FIG. 7, so that the driving control unit 22 references a lookup table $\mathbf{50}_i$ corresponding to a sub-field $SF_i$ (i is an integer from one to N) when determining the number of discharge sustain pulses to be assigned to the sub-field $SF_i$.

Figure 8:
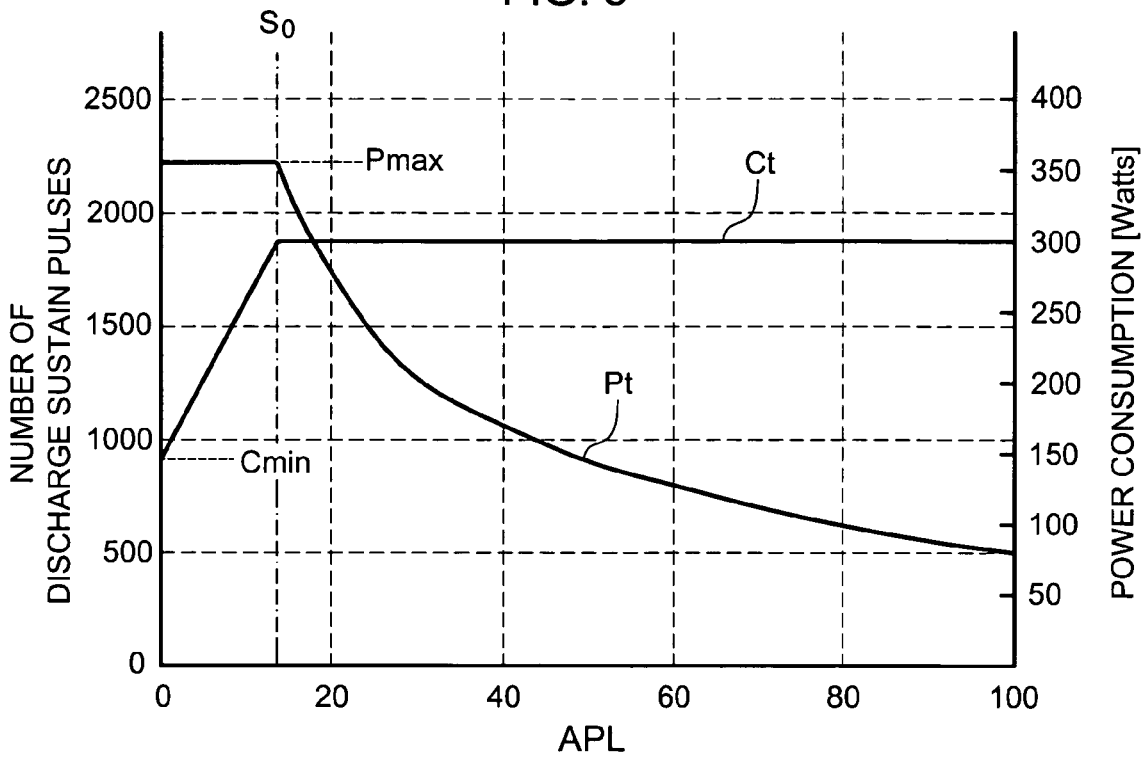
FIG. 8 is a graph showing an example of a relationship (ABL characteristic) between an average peak level and the number of discharge sustain pulses.
Figure 9:
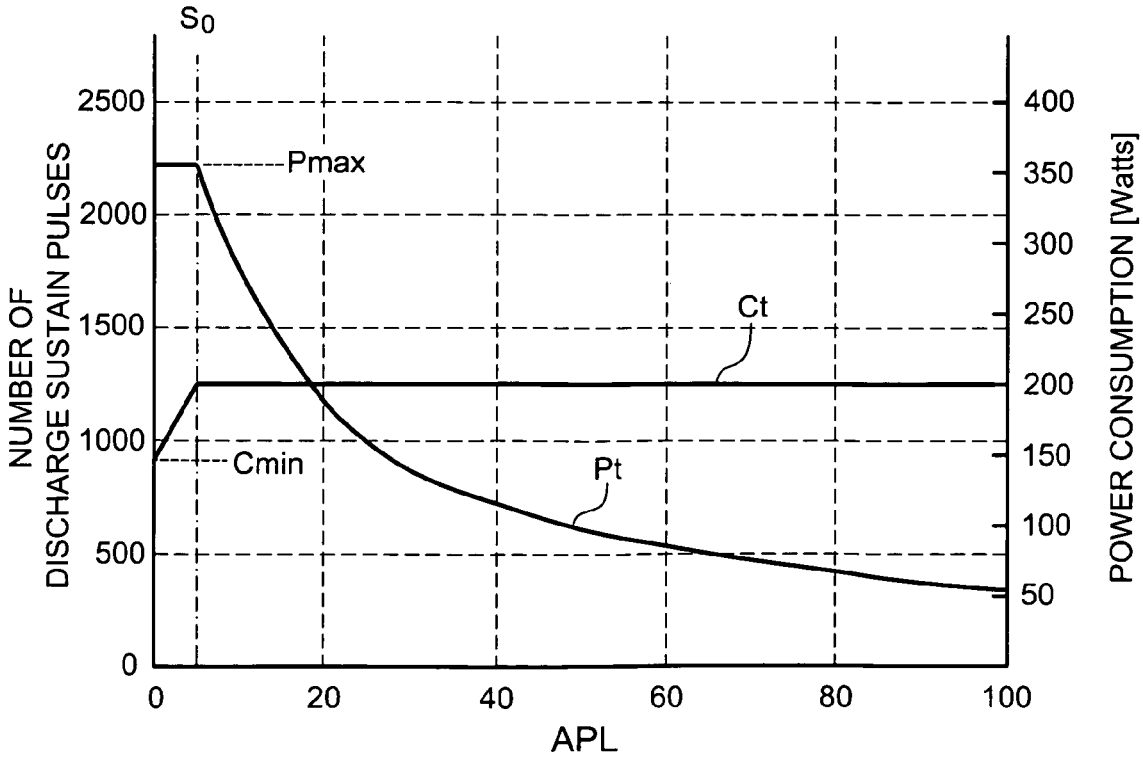
FIG. 9 is a graph showing another example of a relationship (ABL characteristic) between the average peak level and the number of discharge sustain pulses.

FIGS. 8 and 9 show examples of the relationship (ABL characteristic) between the average peak level and the number of discharge sustain pulses in the lookup table as described above. In FIGS. 8 and 9, the horizontal axis of the graph corresponds to the average peak level (APL), while the left vertical axis of the graph corresponds to the number of discharge sustain pulses. A curve Pt is an ABL characteristic curve which represents the relationship between the APL and the number of discharge sustain pulses. It should be noted that the values of average peak levels in the graphs are normalized to have the value of "100" when all the discharge cells CL emit light at the highest gradation level, i.e., when the entire screen of the display panel 2 emits light at the highest peak luminance. Also, the right vertical axis of the graph corresponds to the power consumption (in Watts) of the plasma display 1. A curve Ct is a power characteristic curve representing a relationship between the APL and the power consumption.

FIG. 8 illustrates an ABL characteristic when a target power consumption is set to 300 Watts (by default). The power characteristic curve Ct monotonously increases from an initial value Cmin to 300 Watts in an initial region of the APL value from zero to $S_0$ (=approximately 13), and levels at approximately 300 Watts in a region of the APL value from $S_0$ to 100. The ABL characteristic curve Pt takes a substantially constant upper limit value Pmax in a region of the APL value from zero to $S_0$, and monotonously decreases in a region of the APL value from $S_0$ to 100. In the initial region, the number of discharge sustain pulses is fixed at the upper limit value Pmax, while the power characteristic curve Ct monotonously increases. On the other hand, in the region of the APL value from $S_0$ to 100, the power consumption (target power consumption) is fixed at 300 Watts, while the ABL characteristic curve Pt monotonously decreases under such limitations. The ABL characteristic curve in the default state has been previously measured and stored in a ROM or the like.

FIG. 9 illustrates an ABL characteristic when the target power consumption is set to 200 Watt. Referring to FIG. 9, in the region of the APL value from 0 to $S_0$, the number of discharge sustain pulses of the ABL characteristic curve is fixed at the upper limit value Pmax, while the power characteristic curve Ct monotonously increases from the initial value Cmin to 200 Watts. In the region of the APL value from $S_0$ to 100, the power consumption (target power consumption) of the power characteristic curve Ct is fixed at 200 Watts, while the ABL characteristic curve Pt monotonously decreases under such limitations.

The database 25 stores lookup tables provided for each power consumption, and the characteristic acquisition unit 24 has a function of retrieving lookup tables $\mathbf{50}_1, \ldots, \mathbf{50}_N$ to be set in the characteristic setting unit 23 in accordance with the target power consumption specified by the power setting unit 26. The database 25 can store, for example, lookup tables (ABL characteristics) corresponding to the power consumptions of 300 Watts, 200 Watts, and 100 Watts, respectively. When no lookup table corresponding to the target power consumption is stored in the database 25, the characteristic acquisition unit 24 also has a function of calculating a lookup table corresponding to the target power consumption using lookup tables stored in the database 25 through interpolation. For example, when the target power consumption of 250 Watts is specified by the power setting unit 26, the characteristic acquisition unit 24 can interpolate an ABL characteristic curve Pt for 250 Watts using the ABL characteristic curve Pt for 300 Watts shown in FIG. 8 and the ABL characteristic curve Pt for 200 Watts shown in FIG. 9. Alternatively, the characteristic acquisition unit 24 can calculate the ABL characteristic curve Pt based on a basic function f(T;x) of the ABL characteristic which has been previously prepared and stored. The basic function f(T;x) relates to the target power consumption T and APL value x, and the functional shape of f(T;x) is uniquely determined by giving the target power consumption T.

As described above, the characteristic acquisition unit 24 obtains a lookup table, i.e., the ABL characteristic curve Pt in accordance with the target power consumption specified by the power setting unit 26. For setting this ABL characteristic curve Pt in the characteristic setting unit 23, the driving control unit 22 can assign the number of discharge sustain pulses for each of the sub-fields $SF_1$-$SF_N$ to adjust the power consumption of the plasma display 1 to the target power consumption. Since the lookup tables are updated each time the target power consumption is specified, the power consumption of the plasma display 1 can be meticulously controlled in accordance with the situation.

Next, the user can directly enter or specify the value of target power consumption, for example, 300, 200, 180 or the like by operating on the input device 30 such as an operation panel provided on the plasma display 1. The input device 30 supplies these input values to the power setting unit 26 which sets the input value from the input device 30 as the target power consumption. Alternatively, the user can enter a value corresponding to the target power consumption instead of directly entering the value of the target power consumption by operating the input device 30. For example, when the user depresses a button corresponding to the target power consumption of 300 Watts from among a plurality of buttons corresponding to 300 Watts, 250 Watts, and 180 Watts, respectively, the input device 30 supplies to the power setting unit 26 a command corresponding to the depressed button, so that the power setting unit 26 sets the target power consumption in accordance with the command communicated from the input device 30.

Further, the user can enter a rate of change in the power consumption of the plasma display 1 by operating the input device 30, for example, 50%, 40%, 33% or the like. The input device 30 supplies to the power setting unit 26 the value of the rate of change, or a command corresponding to the rate of change, and the power setting unit 26 calculates the target power consumption in accordance with the specified rate of change, and sets the calculated target power consumption. For example, when the rate of change (reduction rate) is specified to be 33%, the target power consumption of 33% is subtracted from the currently set target power consumption, and the resulting amount is set to a new target power consumption. The power supply circuit 28 comprises the power consumption detector 29 for detecting the amount of power consumed at each of the processing blocks in the plasma display 1, and supplies detected data to the power measuring unit 27. The power measuring unit 27 calculates the overall power consumption of the plasma display 1 based on the detected data supplied from the power consumption detector 29, and supplies the overall power consumption to the power setting unit 26. When the foregoing rate of change is specified, the power setting unit 26 can also subtract the rate of change in the power consumption from the power consumption of the plasma display 1 to set the resulting amount to the target power consumption.

Figure 10A:
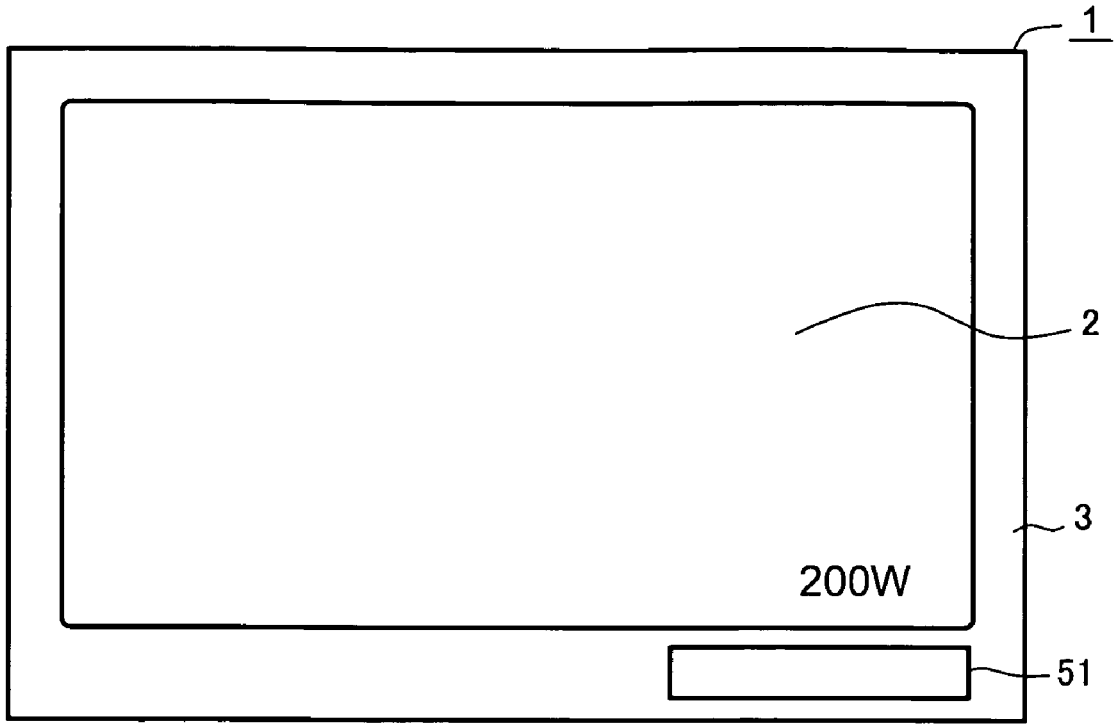
FIG. 10 is a diagram showing an example of displaying a target power consumption.

The value of the target power consumption set by the power setting unit 26 can be displayed on the display panel 2 or on a separate display unit independent of the display panel. Specifically, the controller 21 outputs the value of the target power consumption set by the power setting unit 26, included in display data DD, to the multiplexer 12. The multiplexer 12 superimposes the display data DD onto an image signal PD input from the signal processor 11, thus displaying the value of the target power consumption on the display panel 2. FIG. 10A is a diagram showing an exemplary display of the value of the target power consumption. As shown in FIG. 10A, the target power consumption "200 W" can be displayed in a lower region of the display panel 2 on the front surface of the display panel 1.

Figure 10B:
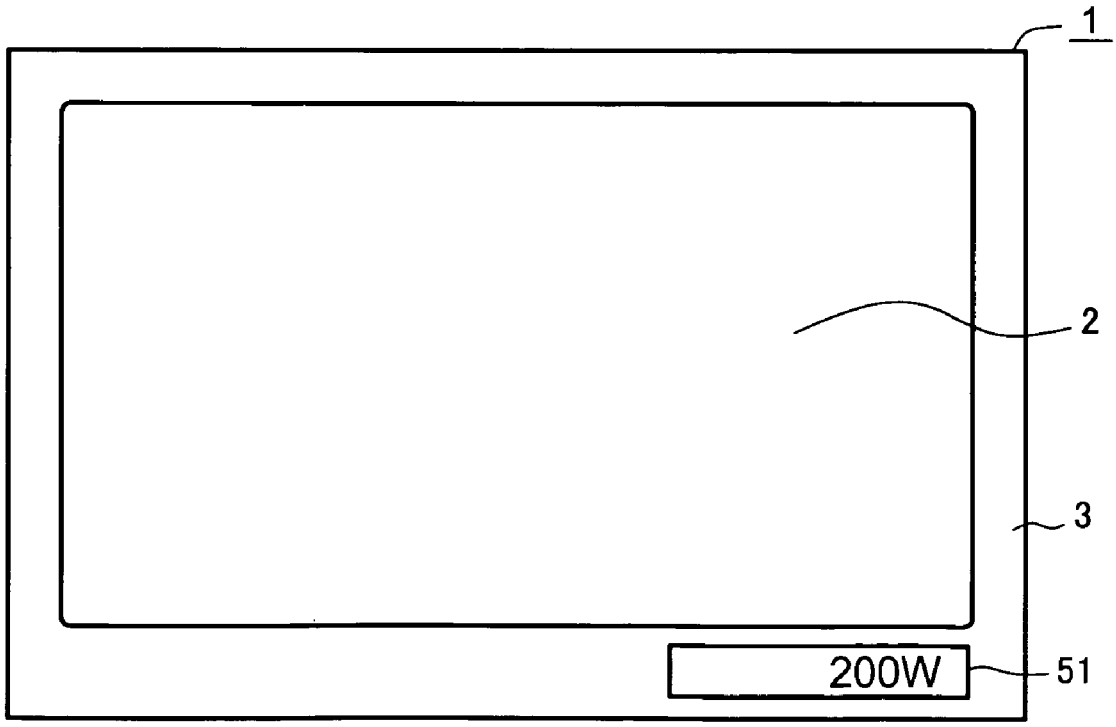

The plasma display 1 also has an auxiliary display unit 51 disposed in the housing 3, and can display the target power consumption on this auxiliary display unit 51. The controller 21 outputs the value of the target power consumption set by the power setting unit 26 to the auxiliary display unit 51 through the output interface unit 31, and can display the target power consumption "200 W" on the auxiliary display unit 51, as shown in FIG. 10B.

Figure 11:
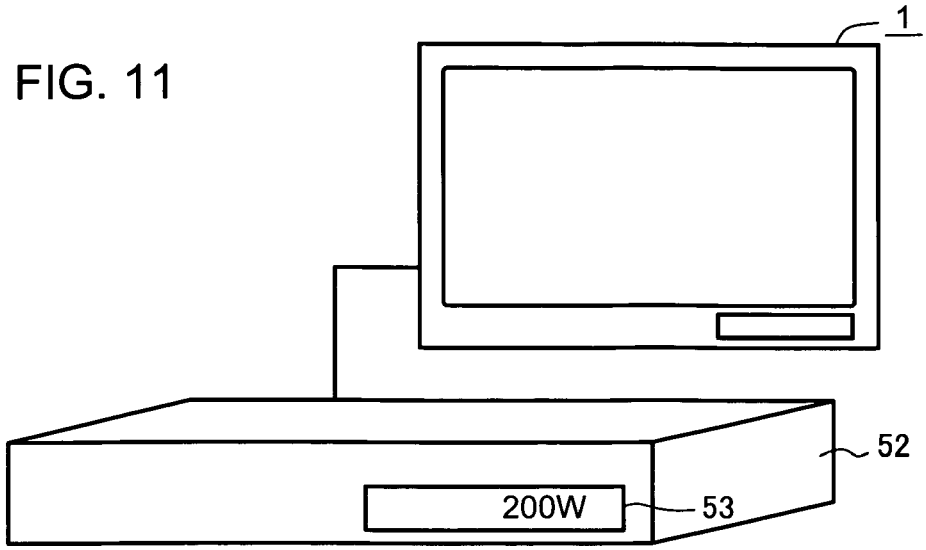
FIG. 11 is a diagram showing an example of displaying a target power consumption.
Figure 12:
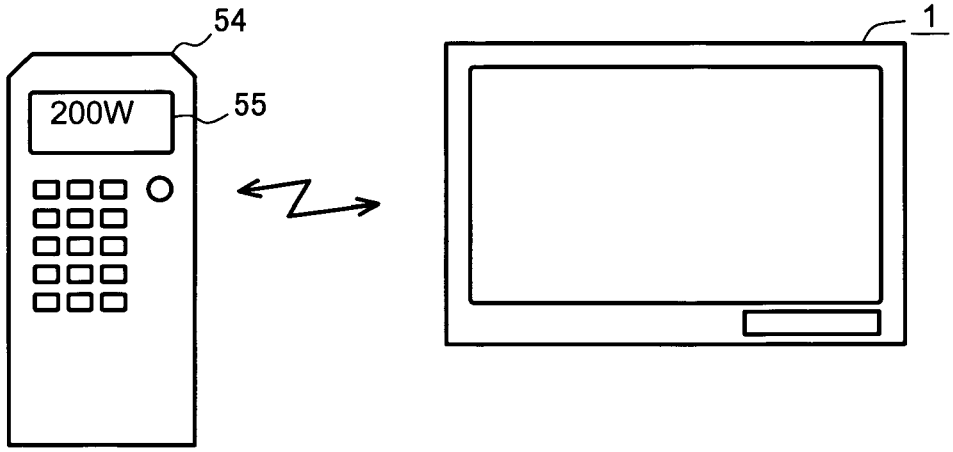
FIG. 12 is a diagram showing an example of displaying a target power consumption.
Figure 13:
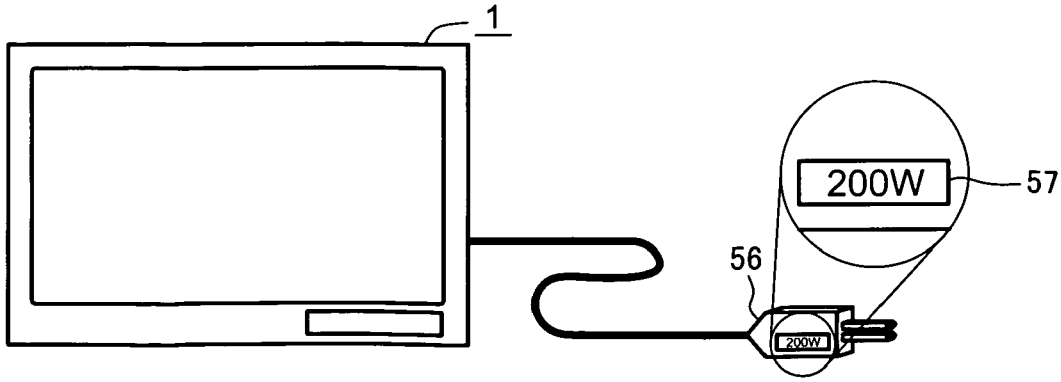
FIG. 13 is a diagram showing an example of displaying a target power consumption.

The controller 21 can further output the value of the target power consumption to an external device through the output interface unit 31 or wireless interface unit 32 to display the target power consumption on a display unit provided in the external device. For example, the target power consumption "200 W" can be displayed on a display unit 53 provided in a media receiver 52, as shown in FIG. 11, the value of the target power consumption can be wirelessly transmitted to a remote controller 54 to display the target power consumption "200 W" on a display unit 55 of the remote controller 54, as shown in FIG. 12, or the target power consumption "200 W" can be displayed on a display unit 57 provided in a power supply plug 56 connected to the power supply circuit 28 (FIG. 1), as shown in FIG. 13.

The user can switch operating states of the display panel 2 and the display units 51, 53, 55, 57 from a target power consumption display state to a non-display state, and vice versa.

Alternatively, instead of displaying the target power consumption on the display panel 2 and display units 51, 53, 55, 57, a message, a character string, or a pattern may be displayed to permit the user to recognize the target power consumption.

The power measuring unit 27 (FIG. 1) has a function of calculating the current power consumption of the plasma display 1 based on detected data supplied from the power consumption detector 29, and measuring the power consumption of the plasma display in units of predetermined periods, such as years, months, or days. Here, the power measuring unit 27 also measures the power consumption during a standby state (standby power) when the main power supply of the plasma display 1 is shut off. The power measuring unit 27 further has a function of calculating the electric rate or electricity charges corresponding to the measured power consumption and storing the calculated electric rate in a memory (not shown).

The controller 21 can display the power consumption measured on a periodic basis, and the electric rate corresponding thereto on the display panel 2 and display units 51, 52, 53, 55, 57. For example, the controller 21 displays the power consumption "50 hWh/month" for one month as shown in FIG. 14A; the power consumption "400 kWh/year" for one year as shown in FIG. 14B; the current power consumption "200 W" in parallel with the power consumption "50 kWh/month" for one month as shown in FIG. 14C; or the current power consumption "200 W" in parallel with the power consumption "50 kWh/month" for one month and the corresponding electric rate "1,000 yens/month."

The unit price used by the power measuring unit 27 for calculating the electric rate (for example, the electric rate per 1 kwh) can be set by the user. Also, the user can reset the power consumption measured on a periodic basis and can reset the electric rates to their initial values.

As described above, since the target power consumption as well as the power consumption measured on a periodic basis and the electric rate are displayed on the display panel 2 and the like, the user can readily view the target power consumption set by operating the input device 30, and can therefore know the power consumption of the plasma display 1 in a simple manner. It is therefore possible to provide the plasma display 1 which can permit the user to realize a reduction in power consumption and can support the power saving in consideration of the earth environment.

It is understood that the foregoing description and accompanying drawings set forth the preferred embodiments of the invention at the present time. Various modifications, additions and alternatives will, of course, become apparent to those skilled in the art in light of the foregoing teachings without departing from the spirit and scope of the disclosed invention. Thus, it should be appreciated that the invention is not limited to the disclosed embodiments but may be practiced within the full scope of the appended claims.

This application is based on a Japanese Patent Application No. 2004-138403 which is hereby incorporated by reference.

What is claimed is:

1. A display device comprising:

a characteristic acquisition unit for obtaining a characteristic indicative of a correspondence relationship between an average peak level and the number of display pulses corresponding to a target power consumption;

an average peak level detector for detecting an average peak level of an input image signal;

a driving control unit for determining the number of display pulses corresponding to the detected average peak level with reference to the characteristic;

a driver for generating a display pulse a number of times equal to the number of display pulses determined by said driving control unit;

a display panel for receiving the display pulses from said driver to emit light at a luminance depending on the number of display pulses;

an input device for supplying an entered value entered by a user as the target power consumption; and a power measuring unit which measures a power consumption of said display device, wherein said display panel displays a power consumption measured by said power measuring unit.

2. A display device according to claim 1, wherein:

said display panel includes a plasma display panel having a plurality of discharge cells arranged in a matrix form, said driver supplies to said discharge cells discharge sustain pulses for causing said discharge cells to emit light as the display pulses, and said driving control unit divides one field of an image to be displayed into a plurality of sub-fields, and with reference to the characteristic, determines the number of discharge sustain pulses to be assigned to each of sub-fields as the number of display pulses.

3. A display device according to claim 1, further comprising a database for storing the characteristics corresponding to respective power consumptions, wherein said characteristic acquisition unit obtains from said database the characteristic causing the power consumption of said display device to be the target power consumption.

4. A display device according to claim 1, wherein said characteristic acquisition unit calculates the characteristic causing the power consumption of said display device to be the target power consumption.

5. A display device according to claim 1, wherein said input device supplies an entered value as a rate of change in the power consumption of said display device, and said display device further comprises a power setting unit for calculating the target power consumption in accordance with the rate of change.

6. A display device according to claim 1, wherein said input device supplies a command corresponding to an entered value, and said display device further comprises a power setting unit for setting power pursuant to the command as the target power consumption.

7. A display device according to claim 1, further comprising:

means for supplying display data corresponding to the target power consumption; and a multiplexer for multiplexing the display data on image data to be displayed on said display panel.

8. A display device according to claim 1, wherein said display device displays the target power consumption.

9. A display device comprising:

an input device which supplies an entered value entered by a user as the target power consumption;

a drive control unit which controls a luminance level correspondingly to said target power consumption;

a display panel which emits light at said luminance level; and a power measuring unit which measures a power consumption of said display device, wherein said display panel displays a power consumption measured by said power measuring unit.

10. A display device comprising:

an input device which supplies an entered value entered by a user as the target power consumption;

a drive control unit which controls a luminance level correspondingly to said target power consumption;

a display panel which emits light at said luminance level;

a power measuring unit which measures a power consumption of said display device; and a display part which displays a power consumption measured by said power measuring unit.

* * * * *